US011276909B2

(12) United States Patent
Ohata et al.

(10) Patent No.: US 11,276,909 B2
(45) Date of Patent: Mar. 15, 2022

(54) NONRECIPROCAL CIRCUIT ELEMENT, MANUFACTURING METHOD OF THE SAME, AND COMMUNICATION APPARATUS USING THE SAME

(71) Applicant: TDK Corporation, Tokyo (JP)

(72) Inventors: Hidenori Ohata, Tokyo (JP); Yoshinori Matsumaru, Tokyo (JP); Tomoaki Kawata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/818,667

(22) Filed: Mar. 13, 2020

(65) Prior Publication Data

US 2020/0295425 A1 Sep. 17, 2020

(30) Foreign Application Priority Data

Mar. 15, 2019 (JP) ..... JP2019-048020

(51) Int. Cl.
*H01P 1/387* (2006.01)
*H01P 1/375* (2006.01)
*H01F 7/02* (2006.01)

(52) U.S. Cl.
CPC ..... *H01P 1/375* (2013.01); *H01F 7/02* (2013.01); *H01P 1/387* (2013.01)

(58) Field of Classification Search
CPC ..... H01P 1/32; H01P 1/36; H01P 1/38; H01P 1/383; H01P 1/387
USPC ..... 333/1.1, 24.2
See application file for complete search history.

(56) References Cited

U.S. PATENT DOCUMENTS 4,209,756 A * 6/1980 Jin ..... H01P 1/387 333/1.1
5,898,346 A 4/1999 Kamei et al.
2005/0231298 A1* 10/2005 Shimizu ..... H01P 1/387 333/1.1
2011/0068877 A1* 3/2011 Chawla ..... H01P 1/387 333/1.1

(Continued)

FOREIGN PATENT DOCUMENTS

CN 102544664 A 7/2012
CN 102760925 A 10/2012

(Continued)

OTHER PUBLICATIONS

Japanese Office Action issued in corresponding Japanese Patent Application No. 2019-048020, dated Jan. 19, 2021, with English translation.

*Primary Examiner* — Stephen E. Jones
(74) *Attorney, Agent, or Firm* — McDermott Will & Emery LLP

(57) ABSTRACT

Disclosed herein is a nonreciprocal circuit element that includes a magnetic rotator disposed between first and second ground conductors, and a permanent magnet that applies a DC magnetic field to the magnetic rotator. The magnetic rotator includes a first ferrite core having a first surface covered with the first ground conductor, a second ferrite core having a second surface covered with the second ground conductor, a first center conductor directly fixed to a third surface of the first ferrite core positioned opposite to the first surface, and a second center conductor directly fixed to a fourth surface of the second ferrite core positioned opposite to the second surface.

17 Claims, 4 Drawing Sheets

(56) References Cited

U.S. PATENT DOCUMENTS

| | | | |
|---|---|---|---|
| 2017/0294696 | A1 | 10/2017 | Cruickshank et al. |
| 2018/0138572 | A1 | 5/2018 | Ohata et al. |

FOREIGN PATENT DOCUMENTS

| | | | |
|---|---|---|---|
| JP | 49-084344 | A | 8/1974 |
| JP | 56-140202 | U | 10/1981 |
| JP | 06-085508 | A | 3/1994 |
| JP | 09-148805 | A | 6/1997 |
| JP | 10-284908 | A | 10/1998 |
| JP | 6231555 | B2 | 11/2017 |

* cited by examiner

NONRECIPROCAL CIRCUIT ELEMENT, MANUFACTURING METHOD OF THE SAME, AND COMMUNICATION APPARATUS USING THE SAME

BACKGROUND OF THE INVENTION

Field of the Invention

The present invention relates to a nonreciprocal circuit element and a communication apparatus using the nonreciprocal circuit element and, more particularly, to an nonreciprocal circuit element such as an isolator or a circulator suitably used in microwave or millimeter-wave frequency bands and a communication apparatus using such a nonreciprocal circuit element. The present invention also relates to a manufacturing method of such a nonreciprocal circuit element.

Description of Related Art

A nonreciprocal circuit element such as an isolator or a circulator is incorporated in, e.g., a mobile communication device like a mobile phone or a communication apparatus used in a base station. As described in Japanese Patent No. 6,231,555, a general nonreciprocal circuit element is constituted of a magnetic rotator having a center conductor and a pair of ferrite cores sandwiching the center conductor and a permanent magnet applying a magnetic field to the magnetic rotator.

However, in conventional nonreciprocal circuit elements, when an unevenness or distortion is present in a center conductor, a grounding conductor, a ferrite core, or the like, a gap may exist between the center conductor and the ferrite core, or between the grounding conductor and ferrite core. The presence of such a gap reduces an effective dielectric constant between the center conductor and the grounding conductor, which poses a problem in that the operation frequency of the nonreciprocal circuit element becomes higher than a designed value.

That is, in an ideal nonreciprocal circuit element, a radius a of the ferrite core is determined by the following expression (1).

$$a = X_a(\theta)\frac{\lambda_0}{2\pi\sqrt{\varepsilon_r\mu_{eff,r}}} \tag{1}$$

In the above expression, $X_a(\theta)$ is a constant obtained from a contact angle $\theta$, $\lambda_0$ is the free-space wavelength of a use frequency, $\varepsilon_r$ is the specific dielectric constant of the ferrite core, and $\mu_{eff,r}$ is an effective permeability. Assuming that the propagation speed of electric wave is v, a use frequency $F_0$ can be represented by $F_0=v/\lambda_0$, so that the expression (1) can be modified into the following expression (1)'.

$$a = X_a(\theta)\frac{v}{2\pi F_0\sqrt{\varepsilon_r\mu_{eff,r}}} \tag{1'}$$

When the expression (1)' is solved for $F_0$, the following expression (2) can be obtained.

$$F_0 = X_a(\theta)\frac{v}{2\pi a\sqrt{\varepsilon_r\mu_{eff,r}}} \tag{2}$$

As is clear from the expression (1)', when the $F_0$ is constant, a reduction in the effective dielectric constant due to existence of the gap increases the radius a of the ferrite core. On the other hand, as is clear from the expression (2), when the radius a of the ferrite core is constant, a reduction in the effective dielectric constant increases the operation frequency.

SUMMARY

It is therefore an object of the present invention to provide a nonreciprocal circuit element capable of preventing a change in electrical characteristics due to a gap between the center conductor and the ferrite core and a communication apparatus using the same. Another object of the present invention is to provide a manufacturing method for such a nonreciprocal circuit element.

A nonreciprocal circuit element according to the present invention has a magnetic rotator disposed between first and second ground conductors and a permanent magnet that applies a DC magnetic field to the magnetic rotator. The magnetic rotator includes a first ferrite core whose one surface is covered with the first ground conductor, a second ferrite core whose one surface is covered with the second ground conductor, a first center conductor directly fixed to the other surface of the first ferrite core, and a second center conductor directly fixed to the other surface of the second ferrite core.

A communication apparatus according to the present invention includes the above nonreciprocal circuit element.

According to the present invention, the first and second center conductors are directly fixed respectively to the first and second ferrite cores, so that no gap is generated therebetween. Thus, it is possible to prevent a change in electrical characteristics due to a gap between the center conductor and the ferrite core.

In the present invention, the first ground conductor may directly be fixed to one surface of the first ferrite core, and the second ground conductor may directly be fixed to one surface of the second ferrite core. With this configuration, no gap is generated between the first ground conductor and first ferrite core and between the second ground conductor and the second ferrite core. Thus, it is possible to suppress a change in electrical characteristics due to a gap between the ground conductor and the ferrite core.

The nonreciprocal circuit element according to the present invention may further have a dielectric that bonds the other surface of the first ferrite core and the other surface of the second ferrite core together. The first ferrite core and the first center conductor may be fixed to each other without interposition of the dielectric, and the second ferrite core and the second center conductor may be fixed to each other without interposition of the dielectric. With this configuration, the first and second ferrite cores can be mutually fixed.

In the present invention, the first and second center conductors may contact each other. Even in this case, the nonreciprocal circuit element can operate properly.

In the present invention, the first and second center conductors may have the same planar shape. With this configuration, influence due to a capacitance component between the first center conductor and the second ground conductor and between the second center conductor and the first ground conductor can be eliminated.

A nonreciprocal circuit element manufacturing method according to the present invention includes the steps of: forming a first ground conductor directly on one surface of a first ferrite core and forming a first center conductor directly on the other surface of the first ferrite core; forming a second ground conductor directly on one surface of a second ferrite core and forming a second center conductor directly on the other surface of the second ferrite core; fixing the first and second ferrite cores such that the other surface of the first ferrite core and the other surface of the second ferrite core face each other; and disposing a permanent magnet that applies a DC magnetic field to the first and second ferrite cores.

According to the present invention, no gap is generated between the ferrite core and the ground conductor and between the ferrite core and the center conductor, so that a dielectric constant between the ground conductor and the center conductor does not change. Thus, it is possible to manufacture a nonreciprocal circuit element having stable electrical characteristics.

In the present invention, the first and second center conductors may be formed on the other surfaces of the first and second ferrite cores, respectively, by printing, plating, or diffusion bonding. This allows the ferrite core and the center conductor to be fixed without gap.

As described above, according to the present invention, it is possible to prevent a change in electrical characteristics due to a gap between the center core and the ferrite core.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
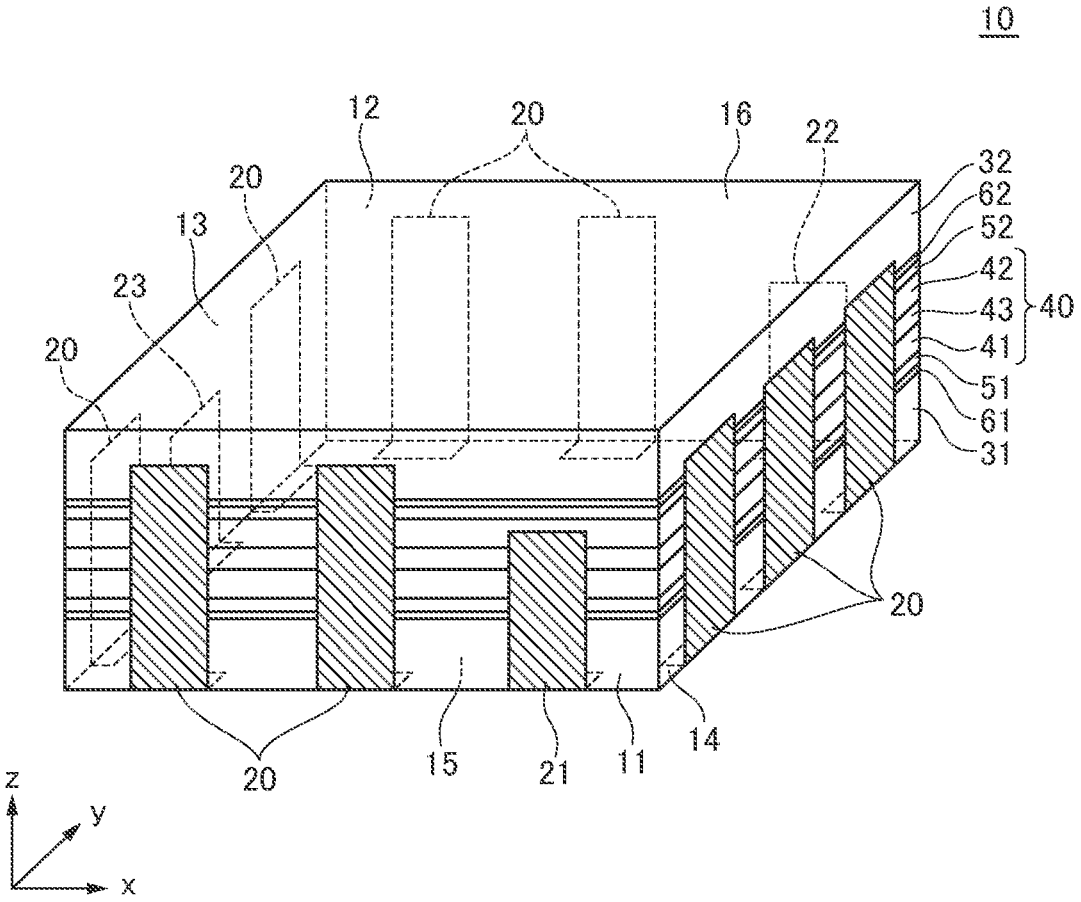
FIG. 1 is a schematic perspective view illustrating the configuration of a nonreciprocal circuit element according to a preferred embodiment of the present invention.
Figure 2:
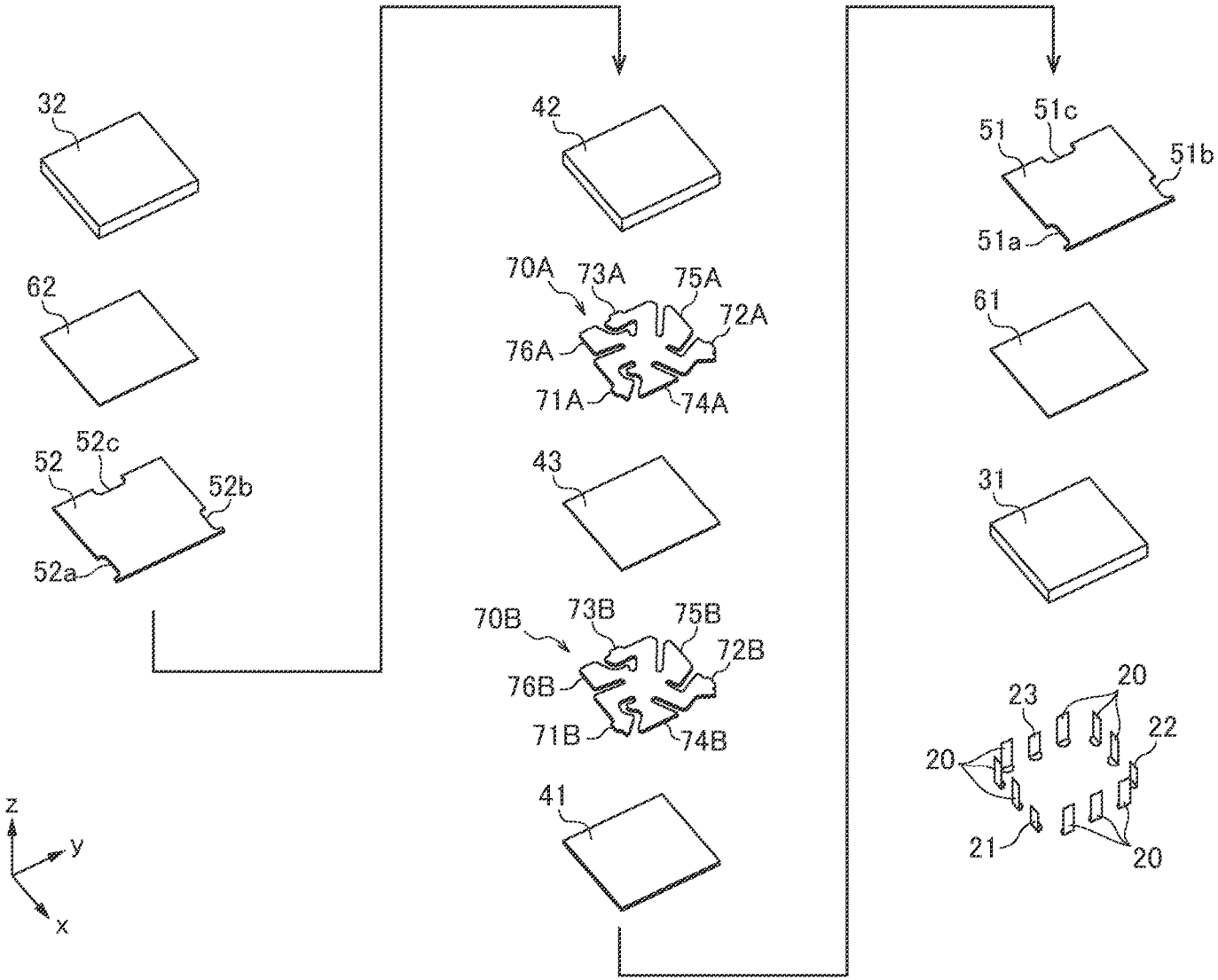
FIG. 2 is a schematic exploded perspective view of the nonreciprocal circuit element shown in FIG. 1.

FIG. 1 is a schematic perspective view illustrating the configuration of a nonreciprocal circuit element 10 according to a preferred embodiment of the present invention. FIG. 2 is a schematic exploded perspective view of the nonreciprocal circuit element 10.

The nonreciprocal circuit element 10 illustrated in FIGS. 1 and 2 is a distributed-constant-type nonreciprocal circuit element. The nonreciprocal circuit element 10 is incorporated in, e.g., a mobile communication device like a mobile phone or a communication apparatus used in a base station and used as an isolator or a circulator. Although not particularly limited, the nonreciprocal circuit element 10 according to the present embodiment is suitably used for a communication apparatus used in a base station.

As illustrated in FIGS. 1 and 2, the nonreciprocal circuit element 10 according to the present embodiment is a surface-mount-type chip component having a substantially rectangular parallelepiped shape and has first and second side surfaces 11 and 12 (xz plane), third and fourth side surfaces 13 and 14 (yz plane), and a mounting surface 15 (xy plane) and a top surface 16 (xy plane). The first side surface 11 is provided with a first external terminal 21, the second side surface 12 is provided with a second external terminal 22, and the third side surface 13 is provided with a third external terminal 23. Further, the first to fourth side surfaces 11 to 14 are each provided with a plurality of ground terminals 20. A portion of each of the external terminals 21 to 23 and ground terminals 20 is tucked under the mounting surface 15.

The three external terminals 21 to 23 are connected to their corresponding signal lines when the nonreciprocal circuit element 10 according to the present embodiment is used as a circulator. On the other hand, when the nonreciprocal circuit element 10 according to the present embodiment is used as an isolator, for example, the external terminals 21 and 22 are connected to their corresponding signal lines, and the external terminal 23 is grounded through a terminal resistor. Further, even when the external terminal 21 or 22 is grounded through a terminal resistor, the nonreciprocal circuit element 10 according to the present embodiment can be used as an isolator. A ground potential is given to the plurality of ground terminals 20 in common.

The nonreciprocal circuit element 10 further has permanent magnets 31 and 32 and a magnetic rotator 40 sandwiched between the permanent magnets 31 and 32 in the z-direction which is the lamination direction. The permanent magnets 31 and 32 apply a DC magnetic field to the magnetic rotator 40. In the present invention, one of the permanent magnets 31 and 32 may be omitted or replaced with an iron plate or the like as a magnetic substrate having small coercive force; however, to perpendicularly apply a strong magnetic field to the magnetic rotator 40, it is preferable to sandwich the magnetic rotator 40 by the two permanent magnets 31 and 32.

The magnetic rotator 40 includes two ferrite cores 41 and 42 and two center conductors 70A and 70B sandwiched between the ferrite cores 41 and 42 in the z-direction. As the material for the ferrite cores 41 and 42, a soft magnetic material such as yttrium/iron/garnet (YIG) is preferably used. The planar shape of each of the center conductors 70A and 70B is as illustrated in FIG. 2, and the center conductors 70A and 70B have respectively three ports 71A to 73A and three ports 71B to 73B which are radially led from the center point thereof and branch conductors 74A to 76A and 74B to 76B for adjusting electrical characteristics. The center conductor 70A and the ferrite core 42 are directly fixed to each other without an adhesive or the like. Similarly, the center conductor 70B and ferrite core 41 are directly fixed to each other without using an adhesive or the like between them. The ferrite cores 41 and 42 adhere to each other through a dielectric 43 having adhesiveness. The dielectric 43 may be interposed between the center conductors 70A and 70B. The center conductors 70A and 70B may partly or entirely contact each other without interposition of the dielectric 43. Preferably, the center conductors 70A and 70B have mutually the same planar shape and accurately overlap each other as viewed in the z-direction.

The tip ends of the first ports 71A and 71B led respectively from the center conductors 70A and 70B are exposed to the first side surface 11 and are thus connected to the first external terminal 21. The tip ends of the second ports 72A and 72B led respectively from the center conductors 70A and 70B are exposed to the second side surface 12 and are thus connected to the second external terminal 22. The tip ends of the third ports 73A and 73B led respectively from the center conductors 70A and 70B are exposed to the third side surface 13 and are thus connected to the third external terminal 23.

The nonreciprocal circuit element 10 according to the present embodiment further has a grounding conductor 51 sandwiched between the permanent magnet 31 and the magnetic rotator 40 in the z-direction and a grounding conductor 52 sandwiched between the permanent magnet 32 and the magnetic rotator 40 in the z-direction. Thus, the center conductors 70A and 70B are sandwiched between the two grounding conductors 51 and 52 and thus isolated from the permanent magnets 31 and 32. The grounding conductor 51 has cuts 51*a* to 51*c* formed at portions respectively overlapping the external terminals 21 to 23, and the grounding conductor 52 has cuts 52*a* to 52*c* formed at portions respectively overlapping the external terminals 21 to 23, thereby preventing the grounding conductors 51 and 52 from interfering with the external terminals 21 to 23. The remaining parts of each of the grounding conductors 51 and 52 are exposed from the first to fourth side surfaces 11 to 14. Thus, the plurality of ground terminals 20 are each connected to both the grounding conductors 51 and 52.

In the present embodiment, the grounding conductor 51 is printed on the lower surface of the ferrite core 41, and the grounding conductor 52 is printed on the upper surface of the ferrite core 42. Thus, the grounding conductor 51 and the ferrite core 41 closely adhere to each other with substantially no gap, and the grounding conductor 52 and the ferrite core 42 closely adhere to each other with substantially no gap. The permanent magnet 31 and the grounding conductor 51 adhere to each other through a dielectric 61 having adhesiveness, and the permanent magnet 32 and the grounding conductor 52 adhere to each other through a dielectric 62 having adhesiveness. The dielectrics 61 and 62 may be formed using the same material as the dielectric 43.

Figure 3:
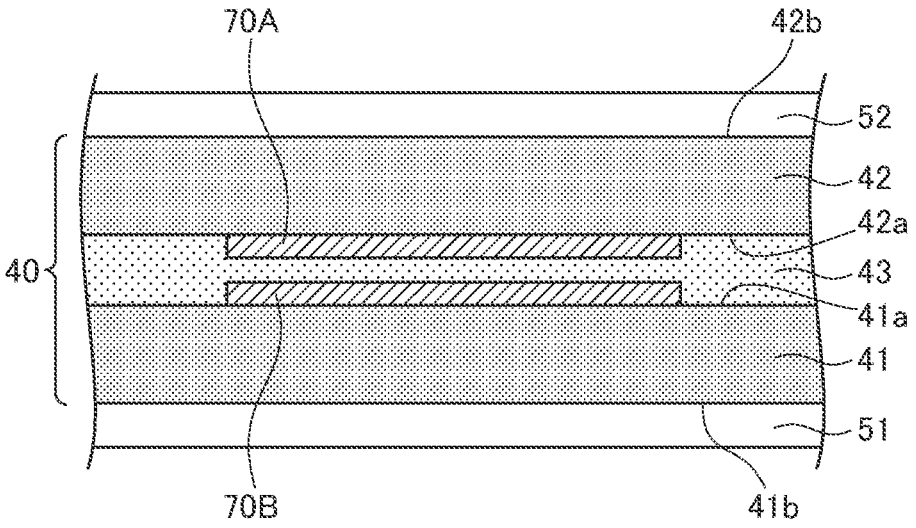
FIG. 3 is a partial cross-sectional view of the magnetic rotator.

FIG. 3 is a partial cross-sectional view of the magnetic rotator 40.

As illustrated in FIG. 3, in the present embodiment, the center conductor 70A is directly fixed to a lower surface 42*a* of the ferrite core 42, and the ground conductor 52 is directly fixed to an upper surface 42*b* of the ferrite core 42. That is, no gap or no separate member is interposed between the lower surface 42*a* of the ferrite core 42 and center conductor 70A, and no gap or another member is interposed between the upper surface 42*b* of the ferrite core 42 and the ground conductor 52. Similarly, the center conductor 70B is directly fixed to an upper surface 41*a* of the ferrite core 41, and the ground conductor 51 is directly fixed to a lower surface 41*b* of the ferrite core 41. That is, no gap or no separate member is interposed between the upper surface 41*a* of the ferrite core 41 and the center conductor 70B, and no gap or no separate member is interposed between the lower surface 41*b* of the ferrite core 41 and the ground conductor 51.

As a result, the dielectric constant between the center conductor 70A and the ground conductor 52 completely coincides with the dielectric constant of the ferrite core 42, and the dielectric constant between the center conductor 70B and ground conductor 51 completely coincides with the dielectric constant of the ferrite core 41. That is, there is no chance at all that effective dielectric constant will change in the presence of a gap or by the interposition of a separate member. Therefore, the nonreciprocal circuit element 10 according to the present embodiment can obtain extremely stable electrical characteristics. In particular, when the center conductor 70A and the center conductor 70B accurately overlap each other as viewed in the z-direction, no capacitance component is added between the center conductor 70A and the ground conductor 51, and no capacitance component is added between the center conductor 70B and the ground conductor 52.

In order to directly fix the center conductors 70A, 70B and the ferrite cores 42, 41, respectively, the center conductor 70A may be directly formed on the lower surface 42*a* of the ferrite core 42, and the center conductor 70B may be directly formed on the upper surface 41*a* of the ferrite core 41. As a concrete method, printing, plating or diffusion bonding can be used. According to these methods, the center conductors 70A and 70B are directly fixed respectively to the ferrite cores 42 and 41, preventing a gap or a separate member from being interposed therebetween. The same applies to the ground conductors 51 and 52. That is, the ground conductors 51 and 52 may be directly formed respectively on the lower surface 41*b* of the ferrite core 41 and on the upper surface 42*b* of the ferrite core 42 using printing, plating or diffusion bonding. Thereafter, the ferrite cores 41 and 42 are fixed through the dielectric 43 having adhesiveness such that the upper surface 41*a* of the ferrite core 41 and the lower surface 42*a* of the ferrite core 42 face each other, followed by disposition of the permanent magnets 31 and 32, and then the ground terminal 20 and external terminals 21 to 23 are formed, whereby the nonreciprocal circuit element 10 according to the present embodiment is completed.

As described above, in the nonreciprocal circuit element 10 according to the present embodiment, the center conductor 70A and the ground conductor 52 are directly fixed to the ferrite core 42, and the center conductor 70B and the ground conductor 51 are directly fixed to the ferrite core 41. Thus, there is almost no chance that the dielectric constant will change, due to variations in manufacturing, between the center conductor 70A and the ground conductor 52 and between the center conductor 70B and the ground conductor 51, whereby extremely stable electrical characteristics can be obtained.

Figure 4:
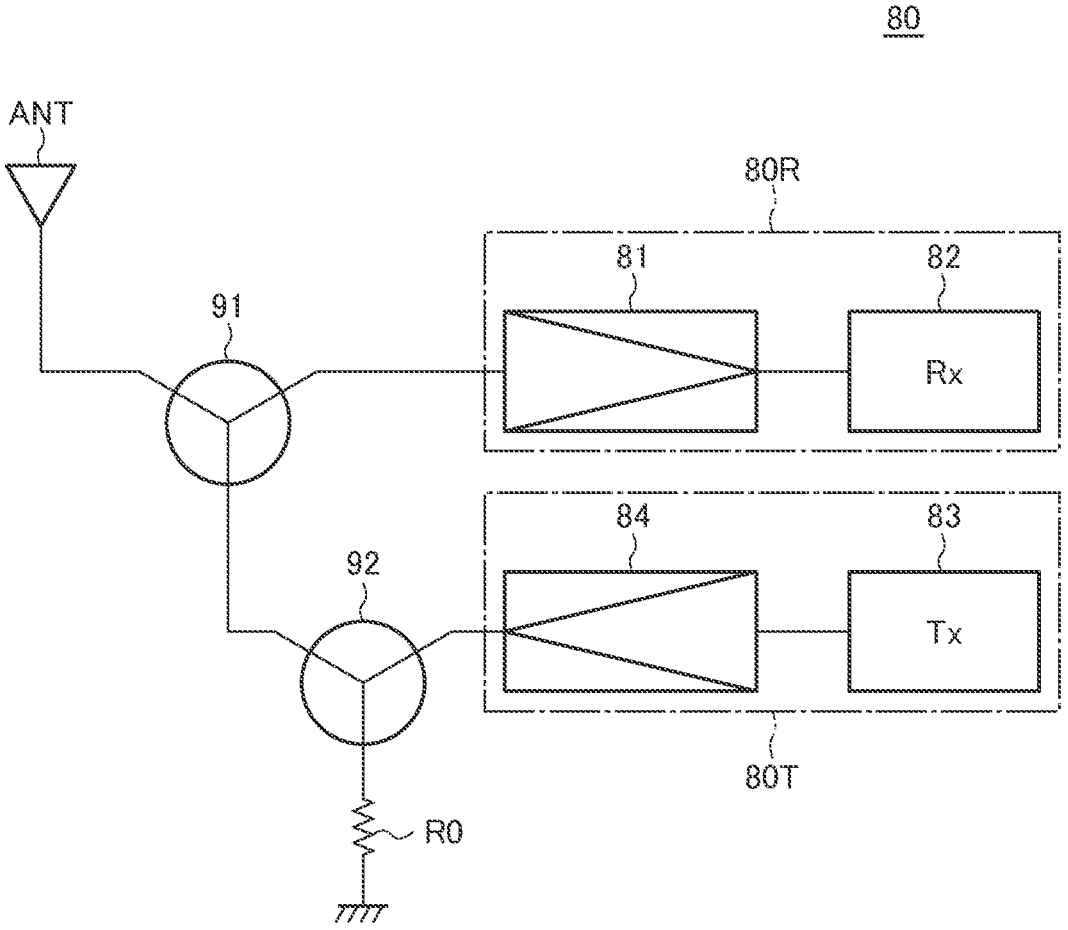
FIG. 4 is a block diagram illustrating the configuration of a communication apparatus using the nonreciprocal circuit element according to a preferred embodiment of the present invention.

FIG. 4 is a block diagram illustrating the configuration of a communication apparatus 80 using the nonreciprocal circuit element according to the present embodiment.

The communication apparatus 80 illustrated in FIG. 4 is provided in a base station in, e.g., a mobile communication system. The communication apparatus 80 includes a receiving circuit part 80R and a transmitting circuit part 80T, which are connected to a transmitting/receiving antenna ANT. The receiving circuit part 80R includes a receiving amplifier circuit 81 and a receiving circuit 82 for processing received signals. The transmitting circuit part 80T includes a transmitting circuit 83 for generating audio signals and video signals and a power amplifier circuit 84.

In the thus configured communication apparatus 80, nonreciprocal circuit elements 91 and 92 according to the present embodiment are used in a path from the antenna ANT to the receiving circuit part 80R and a path from the transmitting circuit part 80T to the antenna ANT, respectively. The nonreciprocal circuit element 91 functions as a circulator, and the nonreciprocal circuit element 92 functions as an isolator having a terminal resistor R0.

It is apparent that the present invention is not limited to the above embodiments, but may be modified and changed without departing from the scope and spirit of the invention.

For example, in the above embodiment, the distributed-constant-type nonreciprocal circuit element is taken as an example; however, the present invention may be applied also to a lumped-constant-type nonreciprocal circuit element.

EXAMPLES

Figure 5:
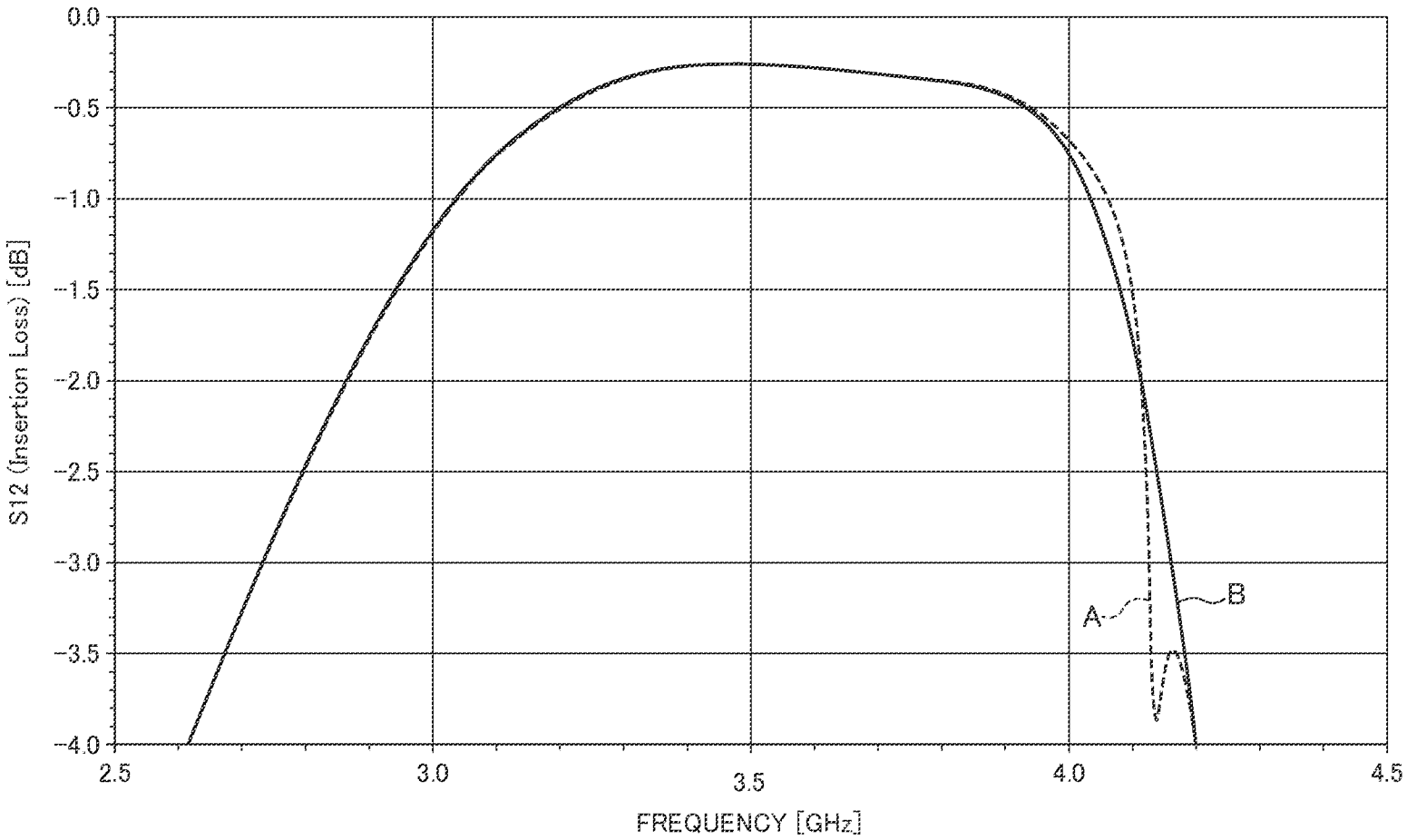
FIG. 5 is a graph indicating an evaluation result of the examples.

Samples A and B of nonreciprocal circuit elements having the same structure of the nonreciprocal circuit element illustrated in FIGS. 1 and 2 were assumed, and passage losses of the respective samples A and B were evaluated by simulation. The dielectric constant of the dielectric 43 was set to 1 and 2.2 in the samples A and B, respectively. Further, a resonance frequency was set to 3.5 GHz in both the samples A and B. Simulation results are illustrated in FIG. 5. Reference signs A and B in FIG. 5 correspond to simulation results of the samples A and B, respectively.

As illustrated in FIG. 5, in both the samples A and B, the passage loss was as very small as about −0.3 dB in a band of 3.3 GHz to 3.8 GHz. Further, no significant difference was not found between the passage losses of the samples A and B in the same band. This is probably because the center conductors 70A and 70B closely contact the ferrite cores 42 and 41, respectively, the dielectric constant of the dielectric 43 has little influence on electrical characteristics.

What is claimed is:

1. A nonreciprocal circuit element comprising:

a magnetic rotator disposed between first and second ground conductors; and a first permanent magnet that applies a DC magnetic field to the magnetic rotator, wherein the magnetic rotator includes:

a first ferrite core having a first surface covered with the first ground conductor;

a second ferrite core having a second surface covered with the second ground conductor;

a first center conductor directly fixed to a third surface of the first ferrite core positioned opposite to the first surface; and a second center conductor directly fixed to a fourth surface of the second ferrite core positioned opposite to the second surface, and wherein the first ground conductor is arranged between the magnetic rotator and the first permanent magnet.

2. The nonreciprocal circuit element as claimed in claim 1, wherein the first ground conductor is directly fixed to the first surface of the first ferrite core, and wherein the second ground conductor is directly fixed to the second surface of the second ferrite core.

3. The nonreciprocal circuit element as claimed in claim 1, further comprising a dielectric material that bonds the third surface of the first ferrite core and the fourth surface of the second ferrite core together, wherein the first ferrite core and the first center conductor is fixed to each other without interposition of the dielectric material, and wherein the second ferrite core and the second center conductor is fixed to each other without interposition of the dielectric material.

4. The nonreciprocal circuit element as claimed in claim 1, wherein the first and second center conductors have a same planar shape.

5. The nonreciprocal circuit element as claimed in claim 1, further comprising a second permanent magnet that applies a DC magnetic field to the magnetic rotator, wherein the second ground conductor is arranged between the magnetic rotator and the second permanent magnet.

6. The nonreciprocal circuit element as claimed in claim 1, wherein the first and second center conductors face each other without a permanent magnet interposed therebetween.

7. The nonreciprocal circuit element as claimed in claim 1, wherein the first and second center conductors contact each other.

8. The nonreciprocal circuit element as claimed in claim 7, wherein each of the first and second center conductors includes first, second, and third ports, wherein the first port of the first center conductor contact the first port of the second center conductor, wherein the second port of the first center conductor contact the second port of the second center conductor, and wherein the third port of the first center conductor contact the third port of the second center conductor.

9. A communication apparatus including a nonreciprocal circuit element, the nonreciprocal circuit element comprising:

a magnetic rotator disposed between first and second ground conductors; and a first permanent magnet that applies a DC magnetic field to the magnetic rotator, wherein the magnetic rotator includes:

a first ferrite core having a first surface covered with the first ground conductor;

a second ferrite core having a second surface covered with the second ground conductor;

a first center conductor directly fixed to a third surface of the first ferrite core positioned opposite to the first surface; and a second center conductor directly fixed to a fourth surface of the second ferrite core positioned opposite to the second surface, and wherein the first ground conductor is arranged between the magnetic rotator and the first permanent magnet.

10. A nonreciprocal circuit element comprising:

a first ferrite core having first and second surfaces opposite to each other;

a second ferrite core having third and fourth surfaces opposite to each other;

an adhesive that that bonds the first and second ferrite cores together such that the first surface of the first ferrite core and the third surface of the second ferrite core face each other;

a first center conductor formed on the first surface of the first ferrite core such that there is no gap or the adhesive between the first surface of the first ferrite core and the first center conductor;

a second center conductor formed on the third surface of the second ferrite core such that there is no gap or the adhesive between the third surface of the second ferrite core and the second center conductor; and a first permanent magnet covering the second surface of the first ferrite core.

11. The nonreciprocal circuit element as claimed in claim 10, wherein the first and second center conductors have a same planar shape.

12. The nonreciprocal circuit element as claimed in claim 10, further comprising a second permanent magnet covering the fourth surface of the second ferrite core.

13. The nonreciprocal circuit element as claimed in claim 10, wherein the first and second center conductors face each other without a permanent magnet interposed therebetween.

14. The nonreciprocal circuit element as claimed in claim 10, further comprising:

a first ground conductor formed on the second surface of the first ferrite core; and a second ground conductor formed on the fourth surface of the second ferrite core.

15. The nonreciprocal circuit element as claimed in claim 14, wherein the first ground conductor is formed on the second surface of the first ferrite core such that there is no gap or the adhesive between the second surface of the first ferrite core and the first ground conductor, and wherein the second ground conductor is formed on the fourth surface of the second ferrite core such that there is no gap or the adhesive between the fourth surface of the second 10 ferrite core and the second ground conductor.

16. A method of manufacturing a nonreciprocal circuit element, the method comprising:

forming a first ground conductor directly on a first surface of a first ferrite core;

forming a first center conductor directly on a second surface of the first ferrite core positioned opposite to the first surface;

forming a second ground conductor directly on a third surface of a second ferrite core;

forming a second center conductor directly on a fourth surface of the second ferrite core positioned opposite to the third surface;

fixing the first and second ferrite cores such that the second surface of the first ferrite core and the fourth surface of the second ferrite core face each other; and disposing a permanent magnet that applies a DC magnetic field to the first and second ferrite cores such that the first ground conductor is arranged between the magnetic rotator and the permanent magnet.

17. The method of manufacturing a nonreciprocal circuit element as claimed in claim 16, wherein the first and second center conductors are formed on the second surface of the first ferrite core and the fourth surface of the second ferrite core, respectively, by printing, plating, or diffusion bonding.

* * * * *